US011565380B1

(12) United States Patent
Bender

(10) Patent No.: US 11,565,380 B1
(45) Date of Patent: Jan. 31, 2023

(54) UNIVERSAL PAINT-LINE HOOK FOR VEHICLE SHOCK

(71) Applicant: DRiV Automotive Inc., Lake Forest, IL (US)

(72) Inventor: Michael Bender, Carleton, MI (US)

(73) Assignee: DRiV Automotive Inc., Southfield, MI (US)

( * ) Notice: Subject to any disclaimer, the term of this patent is extended or adjusted under 35 U.S.C. 154(b) by 0 days.

(21) Appl. No.: 17/522,993

(22) Filed: Nov. 10, 2021

(51) Int. Cl.
*B25B 11/00* (2006.01)
*B05B 13/02* (2006.01)

(52) U.S. Cl.
CPC ..... *B25B 11/00* (2013.01); *B05B 13/0264* (2013.01)

(58) Field of Classification Search
CPC . B25B 11/00; B05B 13/0264; B05B 13/0447; B05B 13/02; B05B 13/0271; B05B 13/0292; B05B 13/0285; B05B 13/025; B66C 1/36; F16B 2/246; B65G 7/61; B05C 13/02; B05C 13/021; B23Q 7/045; A47F 5/0006
USPC ..... 269/46, 55; 294/82.19, 82.17; 248/407, 248/309.2, 316.5, 409, 222.13, 211.11, 248/320, 339, 301, 322, 354.3, 354.6, 248/326, 230.2, 230.4, 681, 336, 300; 254/227, 108, 103; 118/500, 503; D8/372, 272, 367
See application file for complete search history.

(56) References Cited

U.S. PATENT DOCUMENTS

| | | | | | |
|---|---|---|---|---|---|
| 1,740,520 | A * | 12/1929 | Murphy | A47F 5/0006 | 211/115 |
| D335,935 | S * | 5/1993 | Rouail | A47F 5/0006 | D28/73 |
| 5,954,314 | A * | 9/1999 | Weisshaar | B25B 27/304 | 29/227 |
| 8,128,306 | B2 * | 3/2012 | Gorza | F16B 7/1454 | 403/109.5 |
| 2003/0025056 | A1 * | 2/2003 | Atchley | B25B 9/00 | 248/339 |
| 2014/0048668 | A1 * | 2/2014 | Jacobson | B25C 7/00 | 248/301 |

FOREIGN PATENT DOCUMENTS

| | | | |
|---|---|---|---|
| CN | 203750744 | U | 1/2014 |
| CN | 210496864 | U | 7/2019 |
| CN | 210614139 | U | 8/2019 |
| CN | 210846887 | U | 10/2019 |
| WO | 2018055241 | A1 | 3/2018 |

* cited by examiner

*Primary Examiner* — Joseph J Hail
*Assistant Examiner* — Steven Huang
(74) *Attorney, Agent, or Firm* — DRiV Automotive Inc.

(57) ABSTRACT

A paint-line hook for vehicle shocks includes a tube, an eye fixed to the tube, and a bracket fixed to the tube below the eye. The tube has a bottom end and a bore extending through the bottom end. The bracket defines a channel configured to engage a mount of a vehicle shock. A latch is rotatably supported by the tube. The tube includes a slot in communication with the bore. The latch extends through the slot and has a handle exterior to the slot and an end positioned to engage a threaded shaft of a vehicle shock in the bore. A vehicle shock may be retained in the tube and the tube acts as a paint shield during paint application to the vehicle shock.

19 Claims, 10 Drawing Sheets

UNIVERSAL PAINT-LINE HOOK FOR VEHICLE SHOCK

BACKGROUND

Paint-line hooks are used to paint vehicle shocks. Specifically, a vehicle shock may be hung from the hook during application of paint to the vehicle shock, e.g., during an electrostatic painting process. Specifically, a paint line may include a plurality of hangers spaced along and hanging from a conveyor. A vehicle shock is hung from each hook as the conveyor moves the hook and vehicle shock by a paint applicator, e.g., through a paint booth in which paint is applied to the vehicle shock.

The vehicle shock is a component of a vehicle suspension system, e.g., on a passenger automobile, cargo transport truck, etc., as is known. The vehicle shock absorbs and damps suspension impulses resulting from driving on uneven surfaces. Example types of vehicle shocks include twin tube, monotube, etc. Specifically, as shown in FIGS. 1-3, the vehicle shock includes a cylinder 102, 202 and a rod 104/stem 204 telescopically received by the cylinder 102, 202. One type of vehicle shock is shown in FIG. 1 and another type of vehicle shock is shown in FIGS. 2 and 3.

In the example shown in FIG. 1, the vehicle shock includes the cylinder 102 and the rod 104. The vehicle shock in FIG. 1 includes a mount 106 (also referred to as an eye mount) fixed to an end of the rod 104 distal to the cylinder 102. A dust shield cap 105 includes a neck 107, as shown in FIG. 1. In such an example, the cylinder 102 is painted and the mount 106 may be painted.

With continued reference to FIG. 1, one type of paint-line hook 108 is shown for hanging the type of shock shown in FIG. 1. The hook 108 includes an eye 110 that receives a hanger (not shown) on the conveyor (not shown) to hang the hook 108 from the conveyor. The hook 108 includes an arm 130 that hangs from the eye 110 and a bracket 112 supported by the arm 130. The bracket 112 includes a channel 114 that receives the neck 107 of the vehicle shock. Specifically, the bracket 112 receives the vehicle shock between a dirt shield cap 105 and the mount 106. The channel 114 is sized to receive the neck 107 and is smaller than the mount 106 such that the mount 106 hangs the vehicle shock on the bracket 112 when the channel 114 receives the neck 107, as shown in FIG. 1. In this arrangement, the conveyor moves the hook 108 and the vehicle shock to the paint applicator, e.g., the paint booth, for application of paint while the vehicle shock is hung on the hook 108. In such an example, paint is applied to the cylinder 102 of the vehicle shock and paint may be (or purposely may not be) applied to the neck 107 and/or mount 106 of the vehicle shock.

In the example shown in FIGS. 2 and 3, the vehicle shock includes the cylinder 202 and the stem 204. The stem 204 is attached to a smooth rod in the cylinder 202 and has a threaded end distal to the cylinder 202. In such an example, the cylinder 202 is painted and at least a distal part of the threaded end is not painted.

With reference to FIG. 2, another type of paint-line hook 208 is shown for hanging the type of shock shown in FIG. 2. The hook 208 includes an eye 210 that receives a hanger (not shown) on the conveyor (not shown) to hang the hook 208 from the conveyor. The hook 208 includes an arm 230 that hangs from the eye 210 and a bracket 212 supported by the arm 230. The bracket 212 includes a channel 214 that receives the stem 204 of the vehicle shock. The channel 214 is sized to receive the stem 204. The hook 208 includes a chain 216 hanging a keyed plate 218 from the arm 230. The keyed plate 218 includes an aperture 232 sized to receive the stem 204. A mask 220 is hollow and sized to receive the stem 204. To hang the vehicle shock from the hook 208, the stem 204 is inserted into the aperture 232 of the keyed plate 218 and the stem 204 is inserted into the channel 214 with the keyed plate 218 above the bracket 212. The keyed plate 218 is sized to be captured by channel 214 and the aperture 232 in the keyed plate 218 is sized to engage threads on the stem 204 such that the stem 204 is retained in the aperture in the keyed plate 218 by friction. The mask 220 is slid over the end of the stem 204 above the keyed plate 218. In this arrangement, the conveyor line moves the hook 208 and the vehicle shock to the paint applicator, e.g., the paint booth, for application of paint while the vehicle shock is hung on the hook 208. In such an example, paint is applied to the cylinder 202 of the vehicle shock and the mask 220 prevents application of paint to the end of the stem 204 distal to the cylinder 202. This maintains the threads at the end of the stem 204 free of paint for proper threaded engagement with a threaded connection after the paint process.

With reference to FIG. 3, another type of paint-line hook 308 is shown for hanging a vehicle shock, e.g., the vehicle shock of the type shown in FIGS. 2 and 3. The hook 308 includes an eye 310 that receives a hanger (not shown) on the conveyor (not shown) to hang the hook 308 from the conveyor. The hook 308 includes a tube 322 hanging from the eye 310. The tube 322 has a bore 324. A latch 326 is rotatably supported by the tube 322. Specifically, a bracket 334 extends outwardly from the tube 322 and the latch 326 is pinned to the bracket 334. The tube 322 includes a slot 328 in communication with the bore 324 and the latch 326 extends through the slot 328 into the bore 324. The latch 326 has a toothed end 336 in the bore 324. To engage the vehicle shock with the hook 308, the threaded end of the stem 204 is inserted into the bore 324. The threaded end of the stem 204 pushes the toothed end 336 of the latch 326 upwardly and rotates the latch 326 relative to the bore 324. After the threaded end of the stem 204 pushes the toothed end 336 upward, the latch 326 and toothed end 336 are sized to pinch the stem 204 against the inner wall of the bore 324 when the threaded end of the stem 204 is dropped downwardly. In this arrangement, the latch 326 retains the stem 204 in the bore 324 by frictional engagement of the toothed end 336 with the threaded end of the stem 204. To release the stem 204 from the bore 324, the latch 326 is rotated to move the toothed end 336 upwardly (i.e., clockwise in FIG. 3) to disengage the toothed end 336 from the threaded end of the stem 204 so that the threaded stem 204 can be released from the bore 324.

It is desirable to paint vehicle shocks of multiple types, e.g., the type shown in FIG. 1 and the type shown in FIGS. 2 and 3, on the same conveyor line and with the same paint applicator. However, having multiple designs of the hook, e.g., hook 108, 208, 308, for the multiple types of vehicle shocks leads to decreased productivity. In situations in which mixed inventory is painted on the same conveyor line, additional manpower and downtime can result from searching for and hanging the correct type of hook for the next type of vehicle shock to be hung on the conveyor line. In addition, types of vehicle shocks that have stems with threaded ends that should not be painted, e.g., stem 204 shown in FIGS. 2 and 3, steps taken in the prior art to prevent paint on the threaded ends, e.g., the mask 220 in FIG. 2, is cumbersome and requires additional parts, manpower, etc. In addition, inadvertent paint application to the threaded ends results in increased scrap. Accordingly, improvement of the paint-line hook is desired.

DETAILED DESCRIPTION

Figure 1:
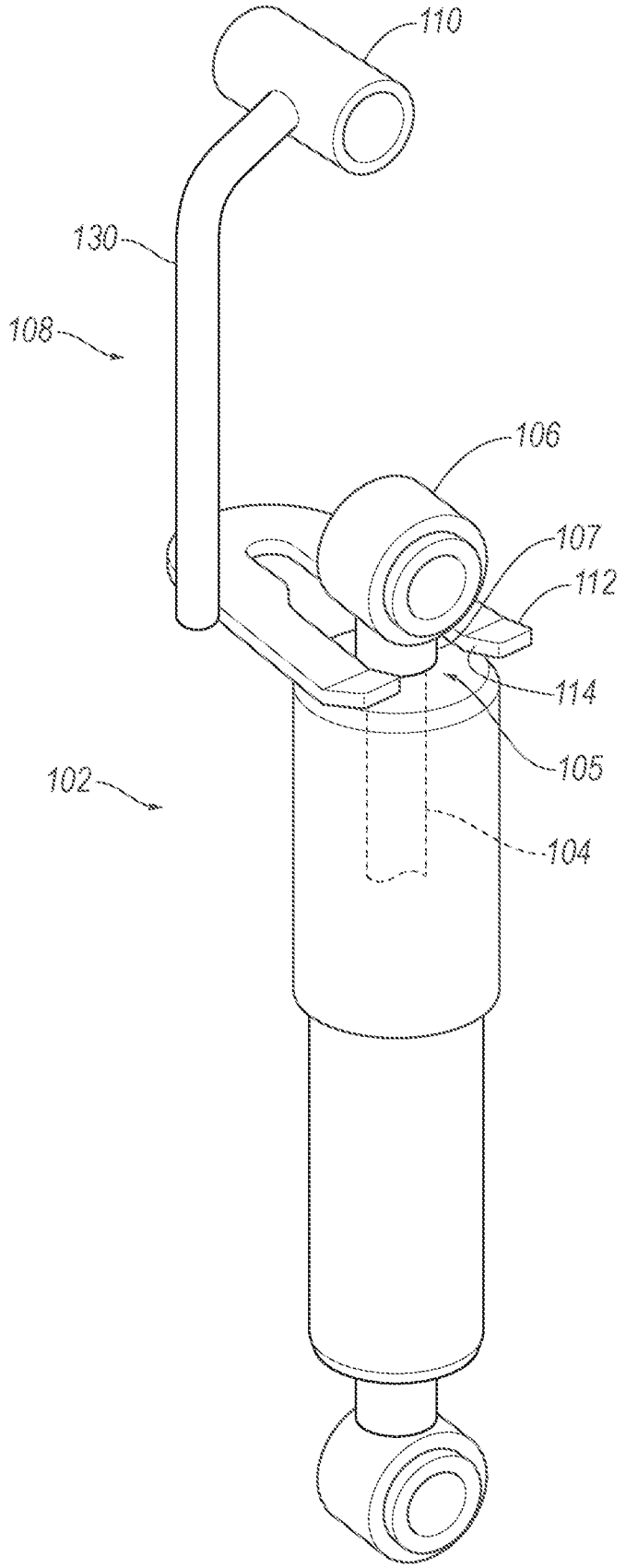
FIG. 1 (Prior Art)
FIG. 1 is perspective view of a prior art paint-line hook and vehicle shock.
Figure 2:
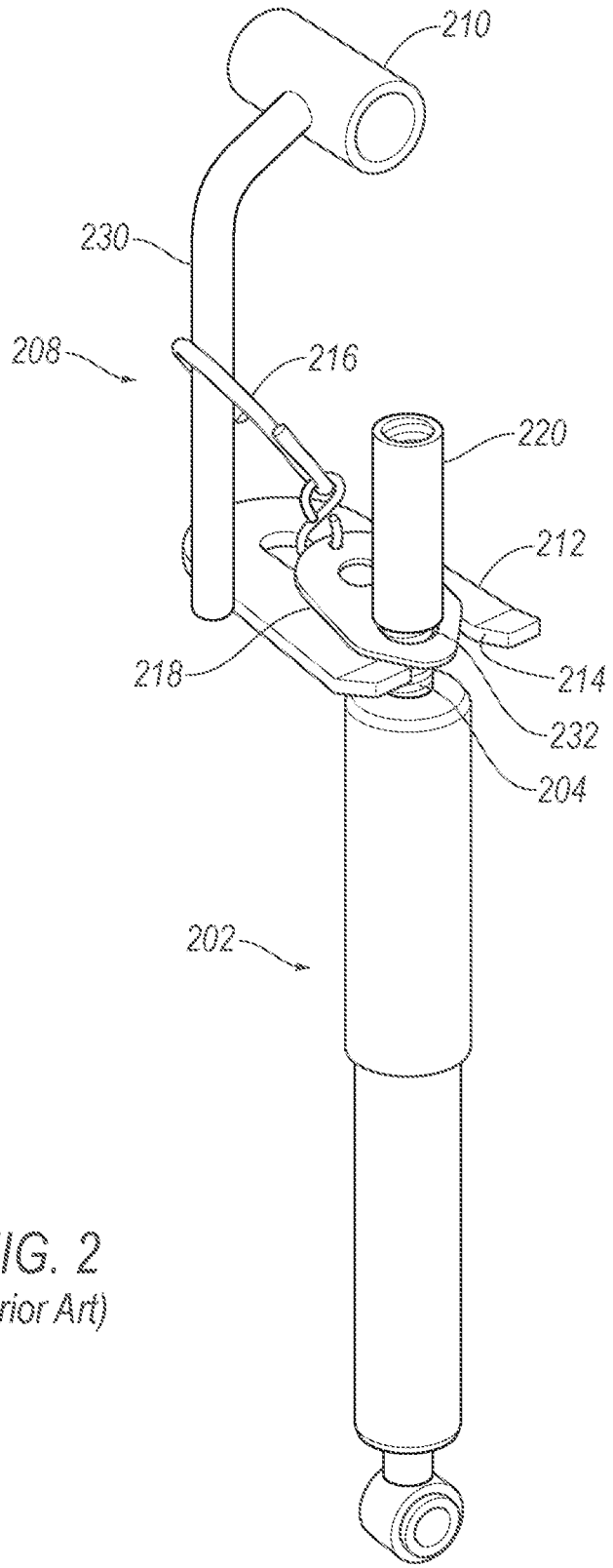
FIG. 2 (Prior Art)
FIG. 2 is a perspective view of another prior art paint-line hook and vehicle shock.
Figure 3:
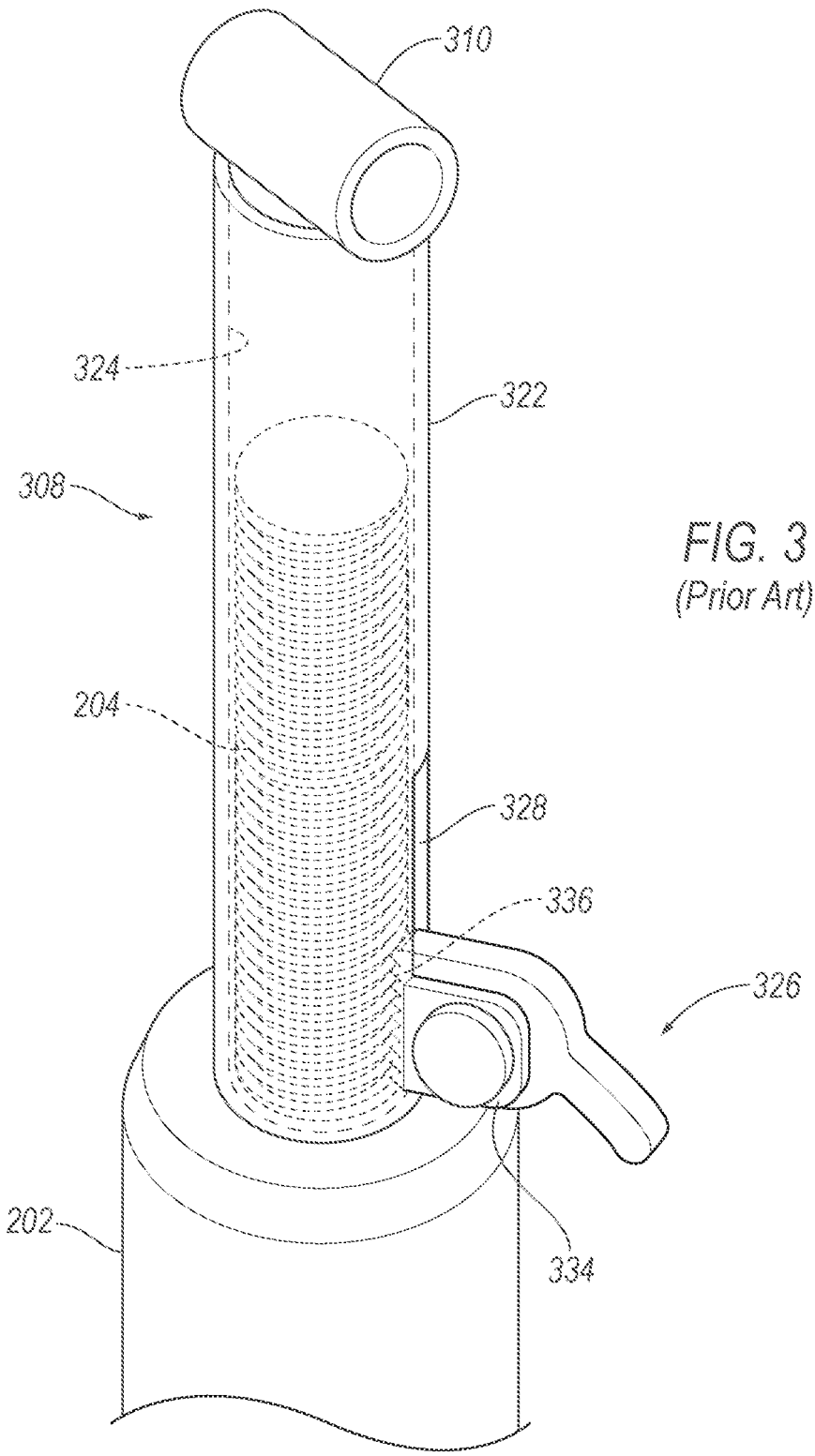
FIG. 3 (Prior Art)
FIG. 3 is a perspective view of another prior art paint-line hook and for the vehicle shock of FIG. 2.

With reference to the Figures, wherein like numerals indicate like parts throughout the several views, a paint-line hook 10 for vehicle shocks 12, 14 includes a tube 16, an eye 18 fixed to the tube 16, and a bracket 20 fixed to the tube 16 below the eye 18. The tube 16 has a bottom end 22 and a bore 30 extending through the bottom end 22. The bracket 20 defines a channel 26 configured to engage a mount 46 of some types of vehicle shocks (e.g., vehicle shock 12 shown in FIG. 6). A latch 28 is rotatably supported by the bracket 52. The tube 16 includes a slot 32 in communication with the bore 30. The latch 28 extends through the slot 32 and has a handle 34 exterior to the slot 32 and an end 36 positioned to engage a threaded end 38 of a stem 40 of some types of vehicle shocks (e.g., vehicle shock 14 shown in FIG. 7) in the bore 30.

Figure 6:
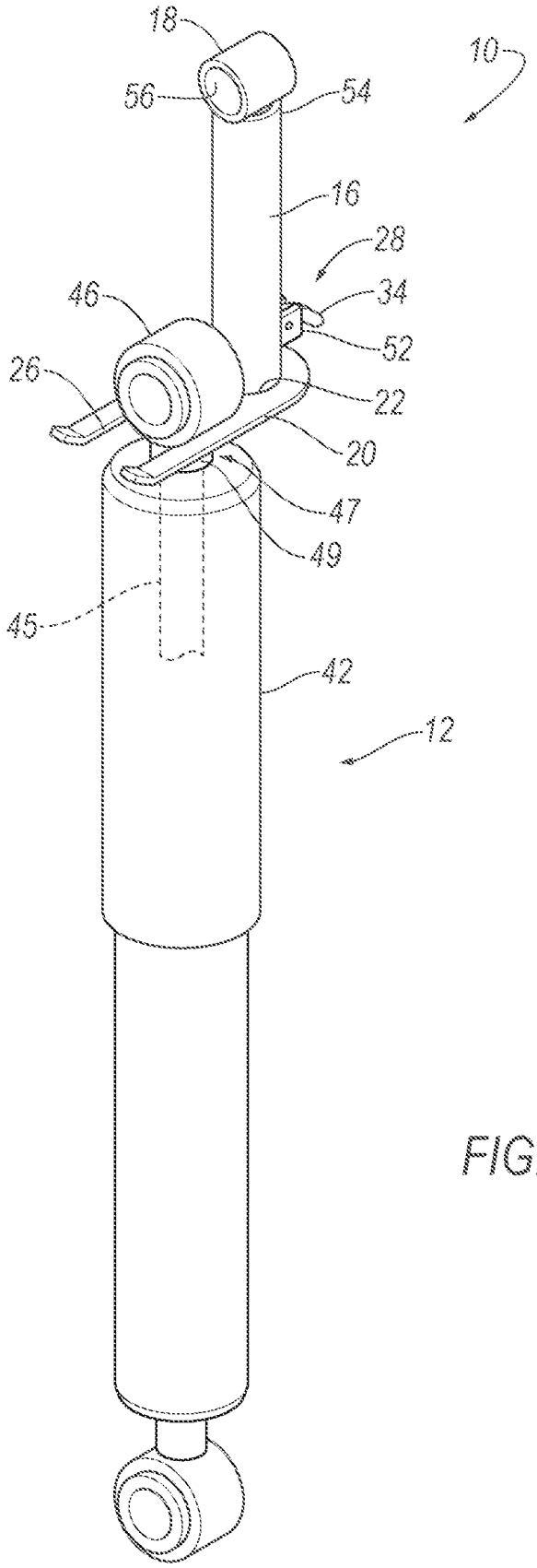
FIG. 6 is a perspective view of the paint-line hook of FIG. 4 with one example type of vehicle shock hanging therefrom.
Figure 7:
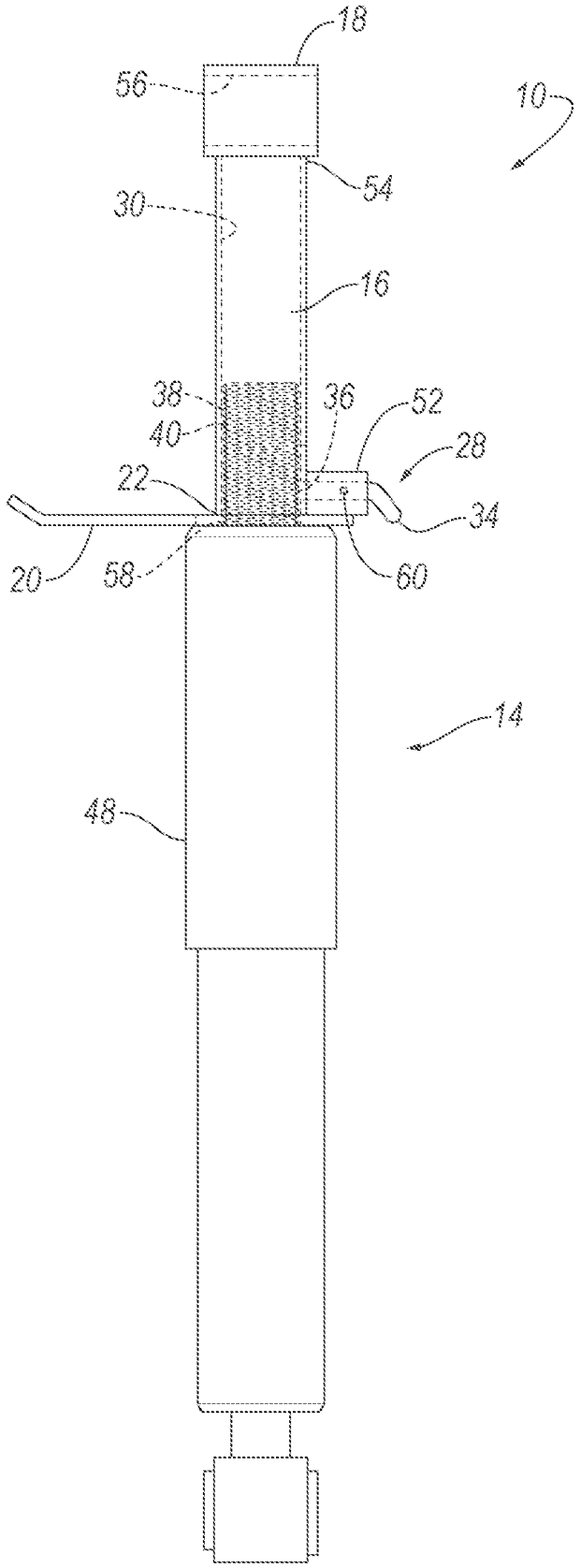
FIG. 7 is a side view the paint-line hook of FIG. 4 with another example type of vehicle shock hanging therefrom.

The hook 10 is universal for multiple types of vehicle shocks, e.g., can be used with both the type of the shock 12 shown in FIG. 6 (i.e., with a smooth rod 45 extending from the cylinder 42 to the mount 46 and a dust shield cap 47 having a neck 49) and the type of the shock 14 shown in FIG. 7 (i.e., with a smooth rod in the cylinder 48 and a stem 40 extending from the smooth rod and having a threaded end 38). This allows for multiple types of shocks to be hung from hooks 10 on a common conveyor line without downtime or manpower required to search for and hang a specific type of hook 10 for a specific type of shock. Specifically, a plurality of hooks 10 of the type shown in FIG. 4 may be hung from a conveyor line and any one of those hooks 10 may be used to hang the type of shock 12 shown in FIG. 6 or the type of shock 14 shown in FIG. 7. The hook 10 may be used for mixed inventory, i.e., with multiple types of shocks hung on the same conveyor line. Also, the hook 10 masks a threaded end 38 of a stem 40 of the shock 14 of the type shown in FIG. 7. This advantageously prevents the application of paint to the threaded end 38. Paint on the threaded end 38 interferes with threaded engagement of the threaded end 38 when assembled to the vehicle.

As set forth above, one type of shock 12 is shown in FIG. 6 and another type of shock 14 is shown in FIG. 7. With reference to FIG. 6, the shock 12 includes the cylinder 42 and the dust shield cap 47 having a neck 49. The shock 12 includes a mount 46 fixed to an end of the dust shield cap 47 distal to the cylinder 42. In such an example, the cylinder 42 is painted and the mount 46 and an exposed portion of the dust shield cap 47 may be painted. In the example shown in FIG. 7, the shock 14 includes the cylinder 48 and the smooth rod 45. The smooth rod 45 has a threaded end 38 distal to the cylinder 48. In such an example, the cylinder 48 is painted and at least a distal part of the threaded end 38 is not painted. The two types of shocks 12, 14 shown in the figures are merely examples and the hook 10 may engage other types of shocks that vary from the shocks 12, 14 shown in the figures, including variation in size, relative dimensions, components, etc. Reference is made to shocks 12, 14 and their components herein merely to illustrate example operation of the hook 10.

Figure 4:
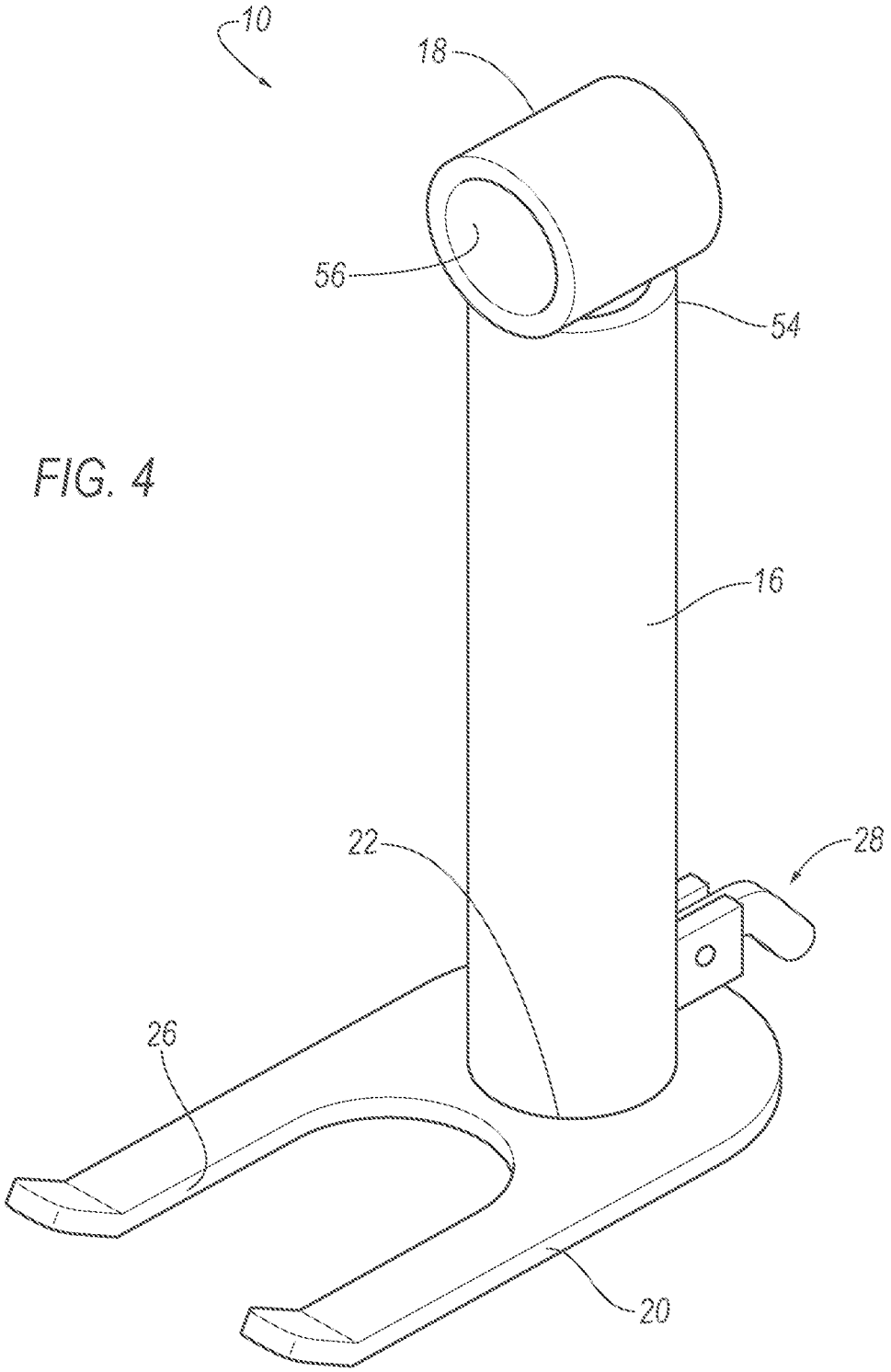
FIG. 4 is a perspective view of a paint-line hook of the present disclosure.
Figure 5:
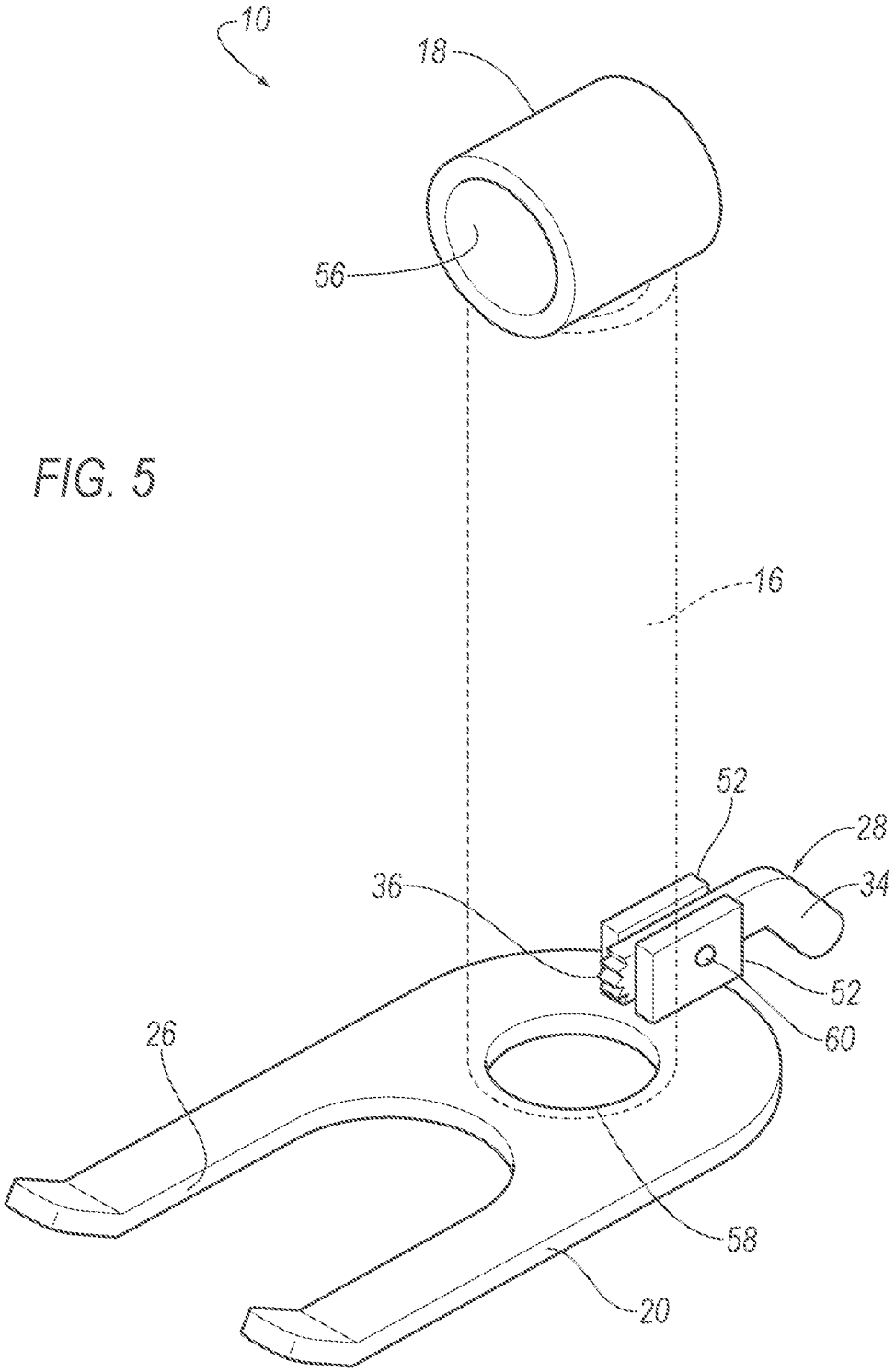
FIG. 5 is a perspective view of the paint-line hook of FIG. 4 with a tube shown in broken lines to show a latch.

With reference to FIGS. 4-5, the hook 10 includes an eye 18 that receives a hanger (not shown) on the conveyor line (not shown) to hang the hook 10 from the conveyor line. The tube 16 hangs from the eye 18 and the bracket 20 is supported by the tube 16. The hook 10 may include a bracket 52 supported by the tube 16. The latch 28 is rotatably supported by the tube 16, e.g., is rotatably connected to the bracket 52. As an example, the hook 10 (e.g., the eye 18, tube 16, bracket 20, bracket 52, and latch 28) may be metal, e.g., steel, aluminum, etc.

With reference to FIGS. 4-5, the tube 16 is elongated from the bottom end 22 to a top end 54. The bore 30 extends through the bottom end 22. The bore 30 extends upwardly at least a sufficient length to receive the threaded end 38 of the stem 40 of the shock 14, as shown in FIGS. 7-10. As an example, the bore 30 may extend from the bottom end 22 to the top end 54. The terms "bottom" and "top" are relative positions when the hook 10 is hung on a conveyor line. The tube 16 is configured to mask the threaded end 38 during paint application to the vehicle shock. Specifically, the tube 16 and the bore 30 are sized and shaped to prevent paint from reaching the threaded end 38 when the threaded end 38 is in the bore 30.

With reference to FIGS. 4-5, the eye 18 may include a cylindrical orifice 56. The cylindrical orifice 56 is sized to receive a hanger of a conveyor line. Specifically, in the example shown in FIGS. 4-5, the eye 18 includes a cylinder fixed to the tube 16. As another example, the eye 18 may be coaxial holes through the tube 16. The eye 18 may be at the top end 54 of the tube 16. The eye 18 may be, for example, welded to the tube 16, e.g., welded to the top end 54 of the tube 16.

The bracket 20 is fixed to the tube 16 below the eye 18. As an example, the bracket 20 may be fixed to the bottom end 22 of the tube 16. In such an example, the bracket 20 includes a hole 58 aligned with the bore 30 of the tube 16, as identified in FIGS. 7-10. The hole 58 may be at least the same size, or larger, than the bore 30 so as to not interfere with entry of the threaded end 38 of the stem 40 of the shock 14 into the bore 30. The bracket 20 may be, for example, welded to the tube 16, e.g., welded to the bottom end 22 of the tube 16.

The bracket 20 includes a channel 26 configured to engage the mount 46 of some types of shocks, e.g., shock 12 shown in FIG. 6. The channel 26 extends through a lower surface and an upper surface of the bracket 20. The channel 26 may narrow inwardly. In other words, the channel 26 extends from an open end to a closed end and may narrow in a direction from the open end to the closed end. The narrowing of the channel 26 may increase retention of a shock on the hook 10 by increasing contact between the neck 49 of the dust shield cap 47 and the bracket 20 at the channel 26. The narrowing of the channel 26 may also allow for channel 26 to accommodate shocks of various sizes having various size smooth rods.

The channel 26 is sized to receive the neck 49 of the dust shield cap 47 in FIG. 6 and is smaller than the mount 46 such that the mount 46 hangs the vehicle shock 12 on the bracket 20 when the channel 26 receives the neck 49, as shown in FIG. 6. In this arrangement, the conveyor moves the hook 10 and the vehicle shock 12 to the paint applicator, e.g., the paint booth, for application of paint while the vehicle shock 12 is hung on the hook 10. In such an example, paint is applied to the cylinder 42 of the vehicle shock 12 and paint may be (or purposely may not be) applied to the dust shield cap 47 and/or mount 46 of the vehicle shock 12.

As set forth above, the latch 28 is rotatably supported by the tube 16. Specifically, the latch 28 may be connected to the tube 16 through the bracket 20, i.e., indirectly connected to the tube 16, with the weight to the latch 28 and the bracket 20 being born by the tube 16 when the hook 10 is hung on a conveyor line. The hook 10 may include a pair of brackets 52, i.e., a first bracket 52 and a second bracket 52. In such an example, the brackets 52 are spaced each other and may extend from the tube 16 parallel to each other. In such an example, the latch 28 is rotatably connected to both brackets 52 and the slot 32 is between the two brackets 52.

The bracket 52 extends outwardly from the tube 16, e.g., radially outwardly from the tube 16. The bracket 52 is supported by the tube 16, i.e., the weight of the bracket 52 is born by the tube 16 when the hook 10 is hung on the conveyor line. The bracket 52 is fixed to the tube 16 and/or the bracket 20. In the example shown in FIGS. 4-10, the bracket 52 is fixed to both the tube 16 and the bracket 20. Specifically, the bracket 52 may abut the tube 16 and the bracket 20 in the example shown in FIGS. 4-10. In such an example, the bracket 52 extends upwardly from the bracket 20 along the tube 16. The bracket 52 may be, for example, welded to the tube 16 and/or the bracket 20.

The latch 28 is rotatably connected to the bracket 52. For example, the latch 28 is pinned relative to the tube 16. In other words, a pin 60 extends through the latch 28 and the bracket 52 and the latch 28 is rotatable relative to the bracket 52 about the axis of the pin 60. In examples including two brackets 52, the latch 28 is rotatably connected to both brackets 52, e.g., pinned to both brackets 52.

The latch 28 has the handle 34 exterior to the slot 32 and the end 36 positioned to engage the threaded end of the stem of a shock, e.g., threaded end 38 of the stem 40 in FIGS. 7-10) in the bore 30, as described below. The latch 28 is pinned to the bracket 52 between the handle 34 and the end 36 of the latch 28. Accordingly, rotation of the handle 34 results in rotation of the end 36 of the latch 28.

Figure 8:
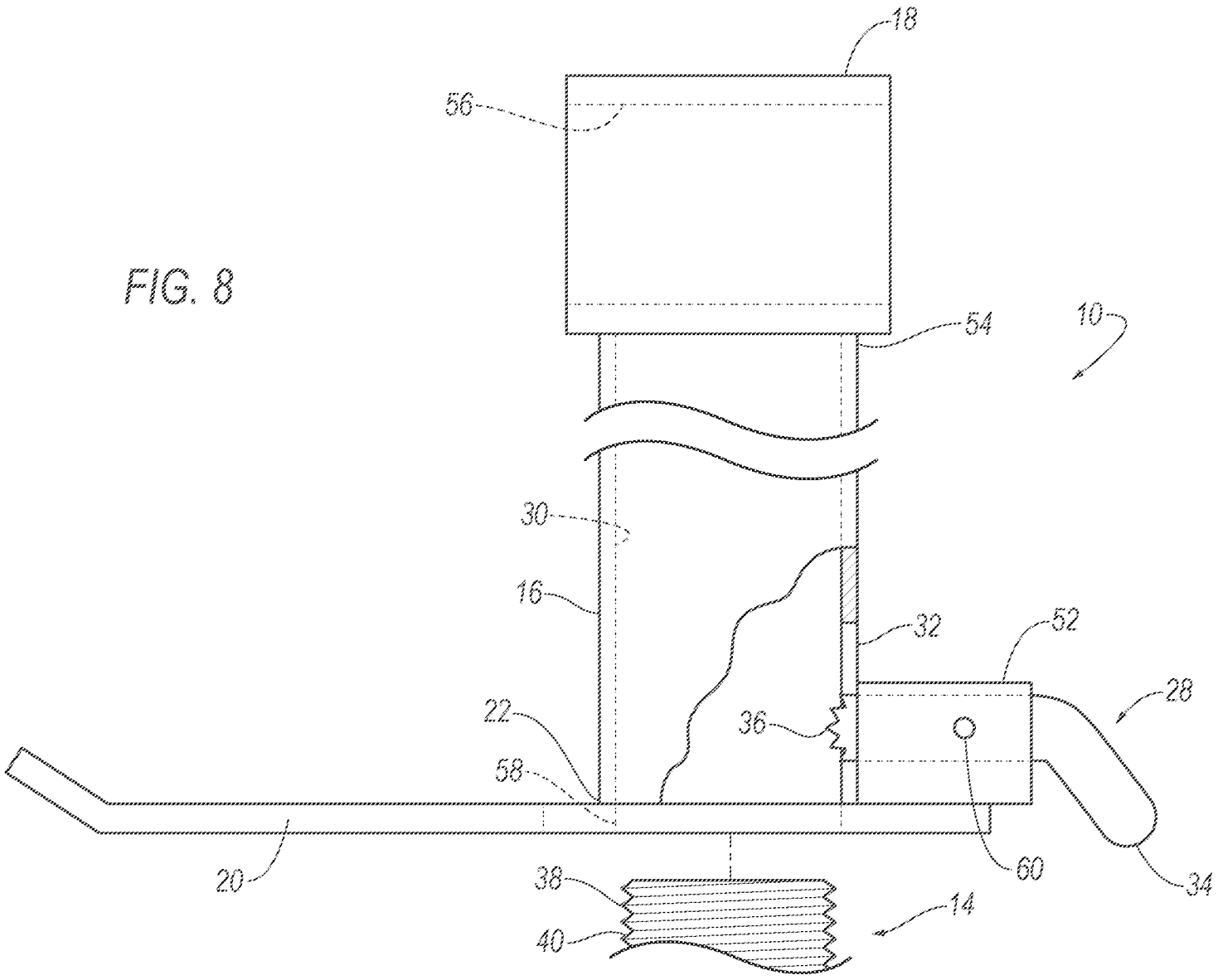
FIG. 8 is a cut-away view of a portion of the paint-line hook and vehicle shock of FIG. 7 before insertion of a threaded end of a stem of the vehicle shock into a bore of the paint-line hook.
Figure 9:
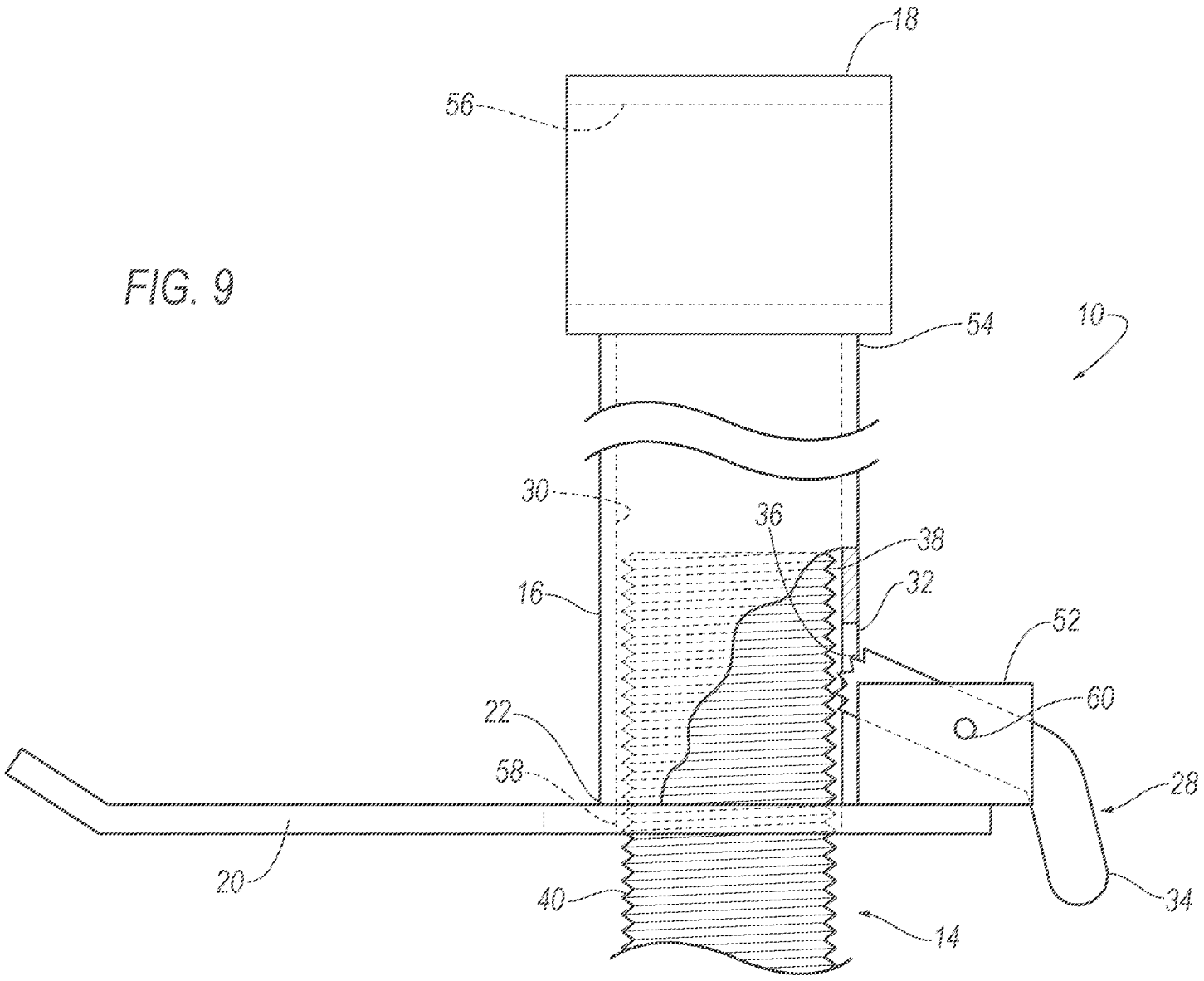
FIG. 9 is the cut-away view of FIG. 8 with the threaded end of the stem inserted into the bore to engage a latch with the threaded end.

The end 36 of the latch 28 is configured to engage threads on the threaded end of the stem of some types of shocks, e.g., the threaded end 38 of the stem 40 of shock 14 in FIGS. 7-10. The end 36 of the latch 28 may be toothed. Specifically, teeth in the end 36 of the latch 28 are configured to engage threads on the threaded end 38 of the stem 40. For example, the teeth in the end 36 may extend along an arced path to accommodate stems 40 of varying diameter. The latch 28 may be rotated between an engaged position (FIGS. 7 and 10) and a raised position (FIG. 9). When the threaded end 38 of the stem 40 is inserted into the bore 30, the threaded end 38 raises the end 36 of the latch 28 to the raised position, i.e., rotates the latch 28 clockwise in FIGS. 8 and 9 from the position in FIG. 8 to the raised position in FIG. 9. Once the end 36 of the latch 28 is engaged with the threads of the threaded end 38 of the stem 40, the stem 40 is lowered, e.g., under the force of gravity, and the end 36 of the latch 28 also lowers, e.g., under the force of gravity and/or friction with the threaded end 38, to the engaged position shown in FIG. 10.

As set forth above, the slot 32 extends through the tube 16 and is in communication with the bore 30. In other words, the slot 32 extends through an outer surface and an inner surface of the tube 16 to allow the latch 28 to extend from an exterior of the tube 16 into the bore 30 through the slot 32. In examples including two brackets 52, the slot 32 is between the brackets 52 such that the latch 28 extends into the slot 32 between the two brackets 52. The slot 32 may be elongated along an axis of the tube 16. The slot 32 may be at the bracket 20, i.e., may extend upwardly from the bracket 20.

Figure 10:
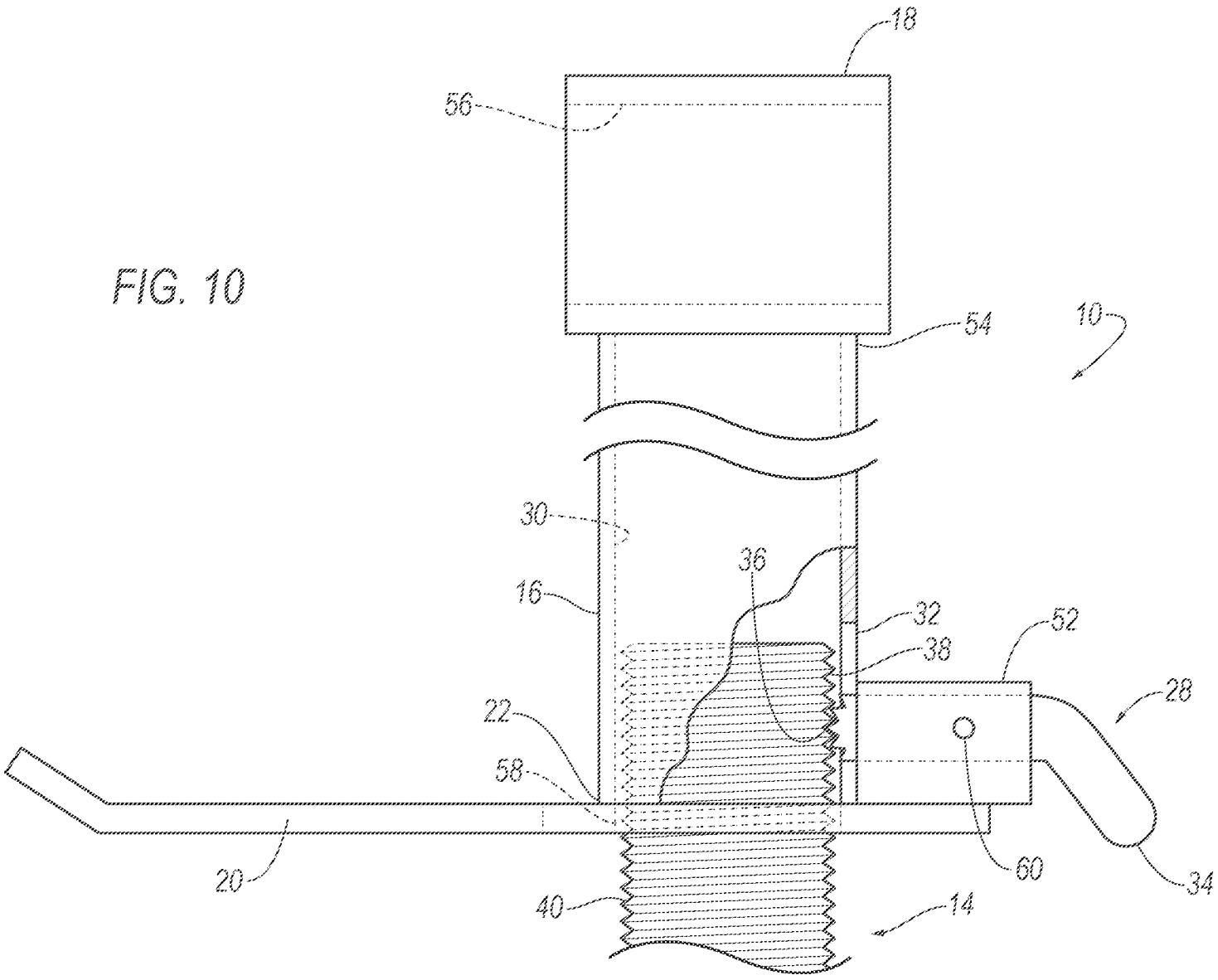
FIG. 10 is the cut-away view of FIG. 8 after the threaded end of the stem is engaged with the latch and subsequently lowered so that the latch retains the stem in the bore.

FIGS. 8-10 shows a progression of the engagement of the threaded end 38 of the stem 40 with the hook 10. Specifically, in FIG. 8, the latch 28 is disposed in the bore 30, i.e., with the end 36 of the latch 28 in the bore 30, and the latch 28 naturally lies in that position under the force of gravity. To engage the vehicle shock 14 with the hook 10, the threaded end 38 of the stem 40 is inserted into the bore 30, as shown in the progression from FIG. 8 to FIG. 9. The threaded end 38 of the stem 40 pushes the end 36 of the latch 28 upwardly and rotates the latch 28 relative to the bracket 52 (i.e., clockwise in FIG. 9). After the threaded end 38 of the stem 40 pushes the end 36 upward, the latch 28 and end 36 are sized to pinch the stem 40 against the inner wall of the tube 16 when the threaded end 38 of the stem 40 is dropped downwardly in the bore 30. In this arrangement, the latch 28 retains the stem 40 in the bore 30 by frictional engagement of the end 36 with the threaded end 38 of the stem 40. Gravity pulls the shock 14 down, which retains the pinching and frictional engagement of the threaded stem 40 by the end 36. In other words, as shown in FIG. 10, under the force of gravity, the threaded stem 40 pulls the end 36 of the latch 28 down (i.e., counter-clockwise rotation in FIG. 10), which jams the latch 28 between the threaded stem 40 and the pin 60. The latch 28 is jammed in that the end 36 does not have space to move down farther due to restraint of the threaded stem 40 and the pin 60. Accordingly, the shock 14 hangs from the hook 10 and is retained in the hook 10 under the force of gravity, which triggers the jam. To release the threaded stem 40 from the bore 30, the latch 28 is rotated to move the end 36 upwardly (i.e., clockwise in FIG. 10) to disengage the end 36 from the threaded end 38 of the stem 40. In other words, the end 36 of the latch 28, and possibly the threaded end 38 of the stem 40, are moved upwardly in the bore 30 to the position shown in FIG. 9. With the latch 28 maintained in this position, i.e., with one hand of the operator, the shock 14 may be removed from the bore 30, i.e., with the other hand of the operator.

When the shock, e.g., shock 14, is hung from the hook 10 in the arrangement shown in FIG. 10, the conveyor moves the hook 10 and the vehicle shock 14 to the paint applicator, e.g., the paint booth, for application of paint while the vehicle shock 14 is hung on the hook 10. When the threaded end 38 of the stem 40 is in the bore 30, the tube 16 masks the threaded end 38 of a stem 40, as shown in FIGS. 7 and 10. This advantageously prevents the application of paint to the threaded end 38 while paint is being applied to the cylinder.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A paint-line hook for vehicle shocks, the paint-line hook comprising:

a tube having a bottom end and a bore extending through the bottom end;

an eye fixed to the tube;

a bracket fixed to the tube below the eye, the bracket defining a channel configured to engage a mount of a vehicle shock;

a latch rotatably supported by the tube;

the tube including a slot in communication with the bore, the latch extending through the slot and having a handle exterior to the slot and an end positioned to engage a threaded shaft of a vehicle shock in the bore.

2. The paint-line hook as set forth in claim 1, wherein the end of the latch is toothed.

3. The paint-line hook as set forth in claim 1, wherein the latch is pinned relative to the tube between the handle and the end of the latch.

4. The paint-line hook as set forth in claim 1, wherein the bracket is fixed to the bottom end of the tube.

5. The paint-line hook as set forth in claim 4, wherein the bracket includes a hole aligned with the bore of the tube.

6. The paint-line hook as set forth in claim 4, wherein the eye is fixed to a top end of the tube.

7. The paint-line hook as set forth in claim 1, wherein the slot is elongated along an axis of bore.

8. The paint-line hook as set forth in claim 1, wherein the slot is at the bracket.

9. The paint-line hook as set forth in claim 1, further comprising a brace fixed relative to the tube and extending radially outwardly from the tube, the lever being rotatably connected to the brace.

10. The paint-line hook as set forth in claim 9, wherein the brace is fixed to the tube.

11. The paint-line hook as set forth in claim 9, wherein the brace is fixed to the bracket.

12. The paint-line hook as set forth in claim 11, wherein the brace extends upwardly from the bracket and is fixed to the tube.

13. The paint-line hook as set forth in claim 9, further comprising a second brace spaced from the brace and extending from the tube parallel to the brace, the lever being rotatably connected to the second brace.

14. The paint-line hook as set forth in claim 13, wherein the slot is between the brace and the second brace.

15. The paint-line hook as set forth in claim 1, wherein the channel narrows inwardly.

16. The paint-line hook as set forth in claim 1, wherein the tube is configured to mask a vehicle shock during paint application to the vehicle shock.

17. A paint-line hook for vehicle shocks, the paint-line hook comprising:

a tube having a top end, a bottom end, and a bore extending through the bottom end;

an eye fixed to the top of the tube;

a bracket fixed to the bottom of the tube and having a hole aligned with the bore of the tube, the bracket defining a channel configured to engage a mount of a vehicle shock;

a brace fixed relative to the tube and extending radially outwardly from the tube;

a latch rotatably connected to the brace;

the tube including a slot in communication with the bore, the latch extending through the slot and having a handle exterior to the slot and an end that is toothed and positioned to engage a threaded shaft of a vehicle shock in the bore.

18. The paint-line hook as set forth in claim 16, wherein the brace is fixed to the tube and to the bracket.

19. The paint-line hook as set forth in claim 17, wherein the brace extends upwardly from the bracket along the tube.

* * * * *